US007150575B1

(12) United States Patent
Minehart

(10) Patent No.: US 7,150,575 B1
(45) Date of Patent: Dec. 19, 2006

(54) FREESTANDING PENHOLDER

(76) Inventor: John Joseph Minehart, 1641 Essex Rd., Apt. #1, Williston, VT (US) 05495

( * ) Notice: Subject to any disclaimer, the term of this patent is extended or adjusted under 35 U.S.C. 154(b) by 0 days.

(21) Appl. No.: 10/752,281

(22) Filed: Jan. 6, 2004

Related U.S. Application Data

(60) Provisional application No. 60/511,371, filed on Oct. 15, 2003.

(51) Int. Cl.
*B43K 23/02* (2006.01)

(52) U.S. Cl. ..... 401/131; 401/48; 401/88; 401/195

(58) Field of Classification Search ..... 401/48, 401/52, 88, 131, 194, 195; 242/357, 912
See application file for complete search history.

(56) References Cited

U.S. PATENT DOCUMENTS

| | | | | |
|---|---|---|---|---|
| 264,593 | A | 9/1882 | Wright | |
| 1,511,167 | A | 10/1924 | Jesnig | |
| 2,027,857 | A | 1/1936 | Buehner | 120/8 |
| 2,703,940 | A * | 3/1955 | Weiller | 40/319 |
| 2,961,257 | A | 11/1960 | Carr | 281/44 |
| 3,570,284 | A | 3/1971 | Hendricks | |
| 4,958,952 | A | 9/1990 | Willett | 401/131 |
| 5,302,811 | A * | 4/1994 | Fukatsu | 235/380 |
| 5,358,348 | A | 10/1994 | Kennedy | 401/131 |
| D352,957 | S | 11/1994 | Lehtimaki | 401/99 |
| D357,703 | S | 4/1995 | Chang et al. | D19/82 |
| 6,065,892 | A | 5/2000 | Smith | 401/209 |
| 6,219,227 | B1 * | 4/2001 | Trane | 361/683 |
| 6,419,413 | B1 | 7/2002 | Oliver et al. | 401/131 |
| 6,575,649 | B1 | 6/2003 | Kuan-Hsiung et al. | 401/131 |
| D480,106 | S | 9/2003 | Man | D19/36 |
| D483,069 | S | 12/2003 | Wang | D19/84 |

* cited by examiner

*Primary Examiner*—Khoa D. Huynh
(74) *Attorney, Agent, or Firm*—Steven E. Kahm; Nikolai & Mersereau, P.A.

(57) ABSTRACT

A penholder having a retractable tether for holding a pen in an upright position adjacent a vertical portion of the stand extending the when not in use for easily finding the pen. The tether extends when the pen is in use but does not interfere with use since little or no tension is exerted on the tether when it is extended. The tether prevents the pen from being taken away from the stand so that it is always available for use. The penholder can have paper holders, paper dispensers, advertising, a business card holder, or pamphlet holder attached, and may have an LCD for a clock, thermometer or calendar display. The penholder may also have a light attached. The base of the penholder may be weighted to help station the penholder on a desktop. The penholder can support trophies or awards and can be used as a promotional item.

34 Claims, 7 Drawing Sheets

FREESTANDING PENHOLDER

CROSS REFERENCE TO OTHER APPLICATIONS

This invention relates to provisional application Ser. No. 60/511,371 filed Oct. 15, 2003.

BACKGROUND OF THE INVENTION

1. Field of the Invention

This invention relates to a retractable writing instrument and more particularly to a stand having a retractable tether with a writing instrument attached to the tether.

2. Description of the Related Art

In banks, stores, restaurants and other places of business pens are provided for customers to use for filling out forms or signing documents, deposit slips, withdrawal slips, credit card slips, or other papers. Since it is desired to have the pen remain in place for the next user various tethers have been attached to the writing instrument to secure the writing instrument to a tabletop, desktop, countertop, or a holder of some type attached to the tabletop, desktop, and countertop. The writing instrument is preferably a pen.

The tether is usually a static fixed length line running from a device for attaching the tether to on one end and securing the pen on the other end. The tether is long enough to permit writing when the paper is near the tether attachment position. When the customer is finished with the pen the tether keeps the pen on the tabletop, desktop or countertop for use by the next person.

In some embodiments the pen is not just laid down on the tabletop, desktop or countertop but inserted into a penholder for securing the pen in an upright position for use by the next person or optionally laid down on the tabletop, desktop or countertop.

If the tether or the penholder is fixed to the tabletop, desktop or countertop it is not portable and limits the range of use of the device. This limits the usefulness of the penholder.

Further for the penholder with a tether the pen can be placed in any number of places relative to the penholder and may not be easy to find on a desk covered with papers or other objects. Therefore it is preferable to have a retractable tether so that the pen will always be in the same position relative to the stand for easily location the pen. It is also preferred to have a portable stand for selecting the placement of the pen on the tabletop, desktop or countertop or for easily moving the penholder to another location.

SUMMARY OF THE INVENTION

The freestanding penholder is useful for providing and retaining pens at a convenient location. The freestanding penholder comprises a base for setting the freestanding penholder on a tabletop, desktop or countertop or other surface. The base is weighted to help keep it from tipping over or sliding on the tabletop, desktop or countertop or other surface when the pen is in use. The base has an upstanding portion, which may be a panel or a tube for supporting the tether such that the pen will be suspended above the base when the tether is in a retracted position. The tether has a spring loaded retractor device for letting the tether unwind when it is in use and for rewinding the tether when the tether is not is use, thus suspending the pen in the air above the stand so that it can be easily located and used. The tether retractor can be located on the base or on the upstanding panel.

The base or upstanding panel may contain a paper holder or paper dispenser. The base or upstanding panel may also have a light.

The base or upstanding panel may have advertising on it such as the name of the bank or store in which it being used or a product brand name when in use at a store.

The upstanding panel may be used as a picture frame for a photograph.

The base or upstanding panel may also be made of a material, which can be written on such as an erasable dry ink marker panel.

The penholder can also be used for trophies or wards and support images or figurines attached thereto.

The penholder can be a part of a desk organizer having a calculator, an electronic database, or a mechanical index card selector. The desk organizer can also have storage slots or trays for holding articles such as pens, rulers, scissors, pencils, pens, erasers, paper clips, rubber bands, and other office supplies or articles.

OBJECTS OF THE INVENTION

It is an object of the invention to provide a pen hanging from a tether on a pen stand for easy access to a pen.

It is an object of the invention to provide a portable pen stand.

It is an object of the invention to provide advertising on a pen stand.

It is an object of the invention to provide a retractable tether on a pen stand to that the pen is always easy to locate on the pen stand.

It is an object of the invention to provide a storage space for paper to be used with the pen.

It is an object of the invention to provide a cardholder to display and dispense business cards or other materials.

It is an object of the invention to provide a writing surface on the pen stand.

It is an object of the invention to provide a light on the pen stand.

It is an object of the invention to provide a penholder in combination with a desk organizer.

It is an object of the invention to provide a penholder desk organizer with a calculator.

It is an object of the invention to provide a penholder desk organizer with an electronic database.

It is an object of the invention to provide a penholder desk organizer with a mechanical index card device.

It is an object of the invention to provide a penholder desk organizer with article storage bins and slots.

It is an object of the invention to provide a penholder desk organizer with a scanner.

It is an object of the invention to provide a penholder desk organizer with a stapler.

It is an object of the invention to provide a penholder combined with a picture frame.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
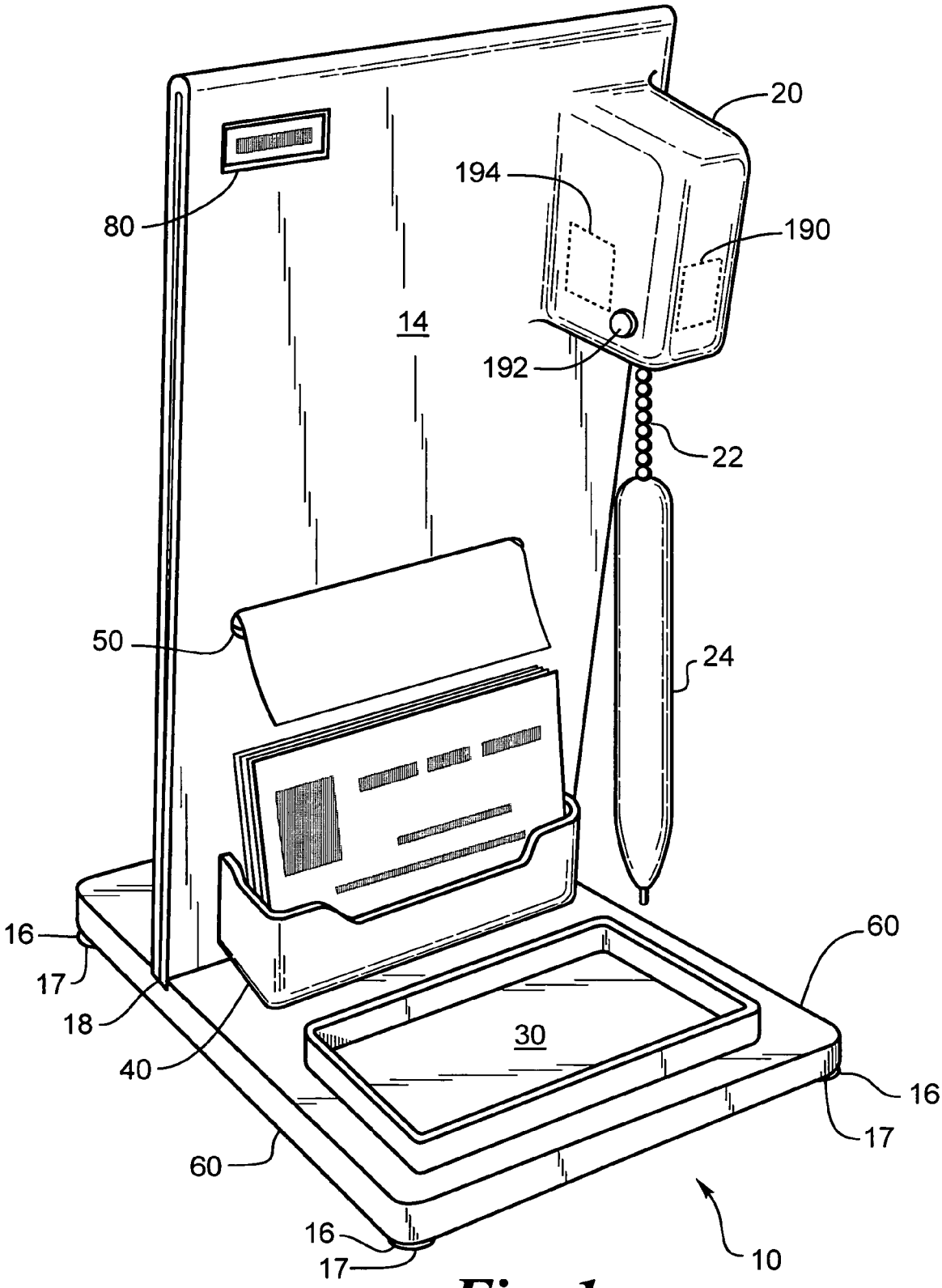
FIG. 1 is a front perspective view of a first embodiment of the freestanding penholder.

The freestanding penholder 10 has a base 12 optionally with feet 16 thereon for engaging a tabletop, desktop or countertop. The feet 16 may have non-skid pads 17 thereon to prevent the freestanding penholder from sliding around while in use. The base may be made of a clear acrylic or any material and be either clear or opaque. The base should have sufficient weight to remain in place while in use without sliding on a desktop, countertop, tabletop or other surface. The base 12 may have a slot 18 for inserting an upstanding wall 14 therein to hold the upstanding wall 14 in place relative to the base 12. The base 12 and the wall 14 may be separate pieces attached to each other or the freestanding penholder can be one integral piece having a base portion 12 and an upstanding wall portion 14.

Figure 2:
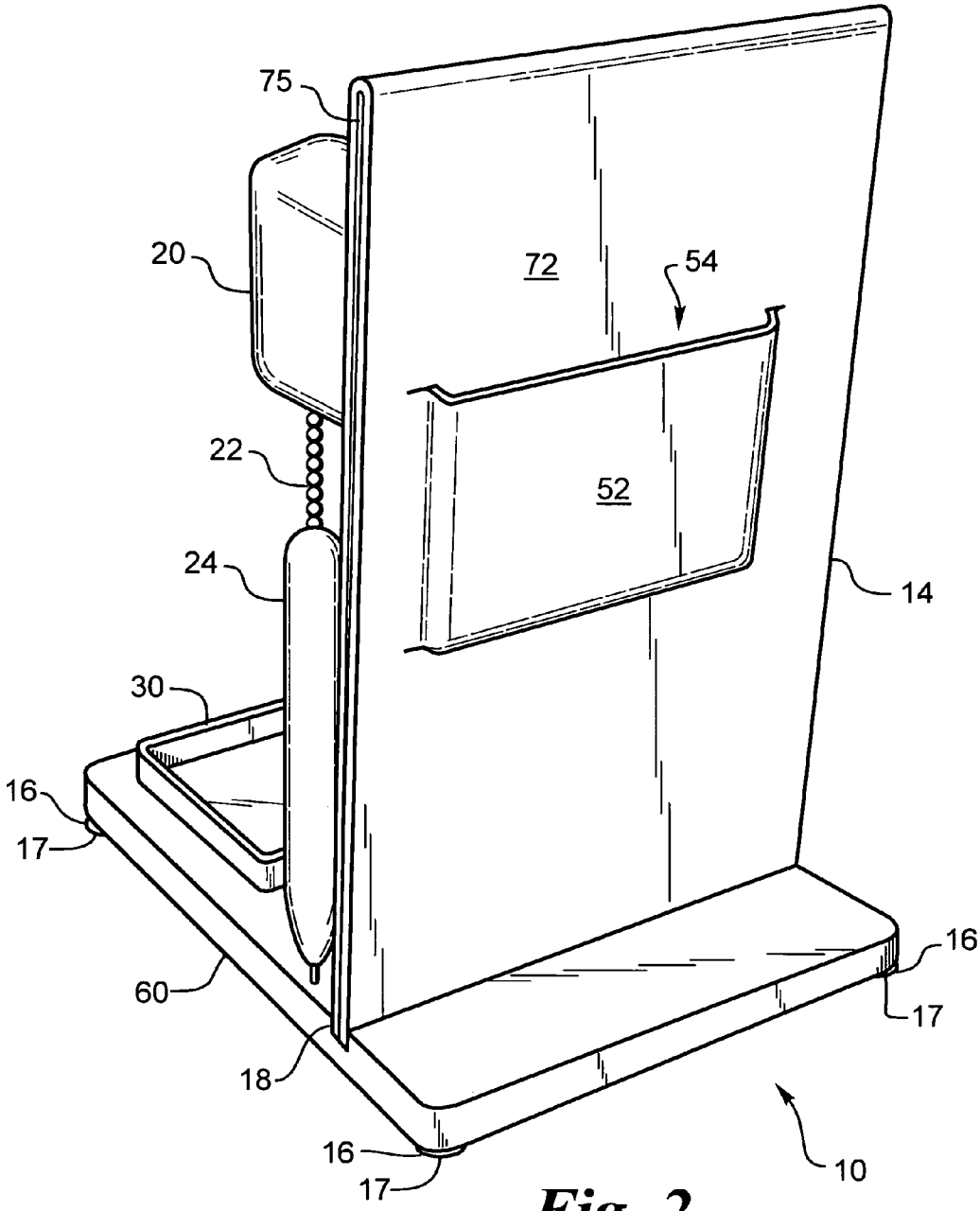
FIG. 2 is a rear perspective view of a first embodiment of the freestanding penholder.

In the first embodiment as shown in FIGS. 1 and 2 a retractable tether mechanism 20 is attached to the upstanding wall portion 14. The retractable tether mechanism 20 has a spring mechanism for letting the tether 22 out when the pen 22 attached to the tether 22 is in use. The retractable tether mechanism 20 retracts the tether together with the pen when the pen is not in use. In the embodiment shown in FIGS. 1 and 2 the retractable tether mechanism 20 is located in the upper right portion of the upstanding wall 14 such that the pen 24 will be dangling underneath the retractable tether mechanism 20 when the tether 22 is retracted. The pen 24 is therefore in an easy to find position when not in uses. When someone needs to use a pen they look for the freestanding pen stand 10, which is easy to find due to it's size and then take the pen in hand and move it to the area needed for writing. The tether 22 will unwind in the retractable tether mechanism 20 but will not have a tension in the tether 22 which will interfere with the user writing with the pen 24. When the user is finished writing with the pen 24 he releases it and the tether 22 will be rewound by the retractable tether mechanism 20 and returned to its initial position hanging from the retractable tether mechanism 20 on the face of the upstanding wall 14 ready for the next use.

Preferably retractable tether mechanism 20 is housed in a see through plastic case so that the retraction mechanism inside is visible.

The freestanding penholder 10 may have other features besides retractably holding a tethered pen 24. The freestanding penholder 10 may optionally have a base 12 with a paper tray 30 for holding paper, which is to be written on. The paper tray 30 may hold a pad of paper or a credit card slip. If the base 12 does not have a paper tray 30 it may have advertising 60 thereon. For example, if the free standing pen holder 10 is located near the cash register in a liquor store for providing a pen for customers to use for signing credit card slips, it may have a beer advertisement on surface 60.

The upright wall 14 may also have advertising 70 on the upright wall, or on the inside of the wall if the wall has an opening for insertion of advertisements therein.

The upright wall 14 or base 12 may have a cardholder 40 attached thereto for displaying and dispensing business cards or brochures, pamphlets, photographs, coupons or advertisements.

The upright wall 14 or base 12, may also have a slot 50 for dispensing paper therethrough such as POST IT NOTES® or other slips of paper. The paper dispenser may have a supply of paper in a paper holder 52 on the reverse side of the upright wall 14 as shown in FIG. 2. The paper holder 52 may have an aperture 54 for supplying paper to the paper holder, or alternatively the paper holder 54 may be totally enclosed and have a removable back portion to restock paper therein.

The upright wall 14 may have advertising 70 on the front and/or advertising 72 on the back. If the upright wall 14 is a "taco" style wall with a slit therein, an advertising card with advertising 70 and or 72 on the front and back of the card may be inserted in the slot 75. The "taco" style upright wall may be used as a picture frame to display photographs.

The upright wall 14 or base 12, may also have a LCD display 80 integral with or attached thereto for providing information such as the time, date, temperature, or other information.

The retractable tether mechanism 20 may have an electrical switch 190 therein which makes contact when the tether 22 is withdrawn from its rest position indicating that the pen 24 is in use. The switch may control a circuit for turning on light 192 by providing a current from battery 194. The light may be used to illuminate the writing area or the advertisement area, 60, 70, 72 or some other area. The switch may also turn on the LCD 80. The switch will be turned off when the pen 24 is no longer in use the tether 22 is retracted to its rest position by the retractable tether mechanism 20.

Figure 3:
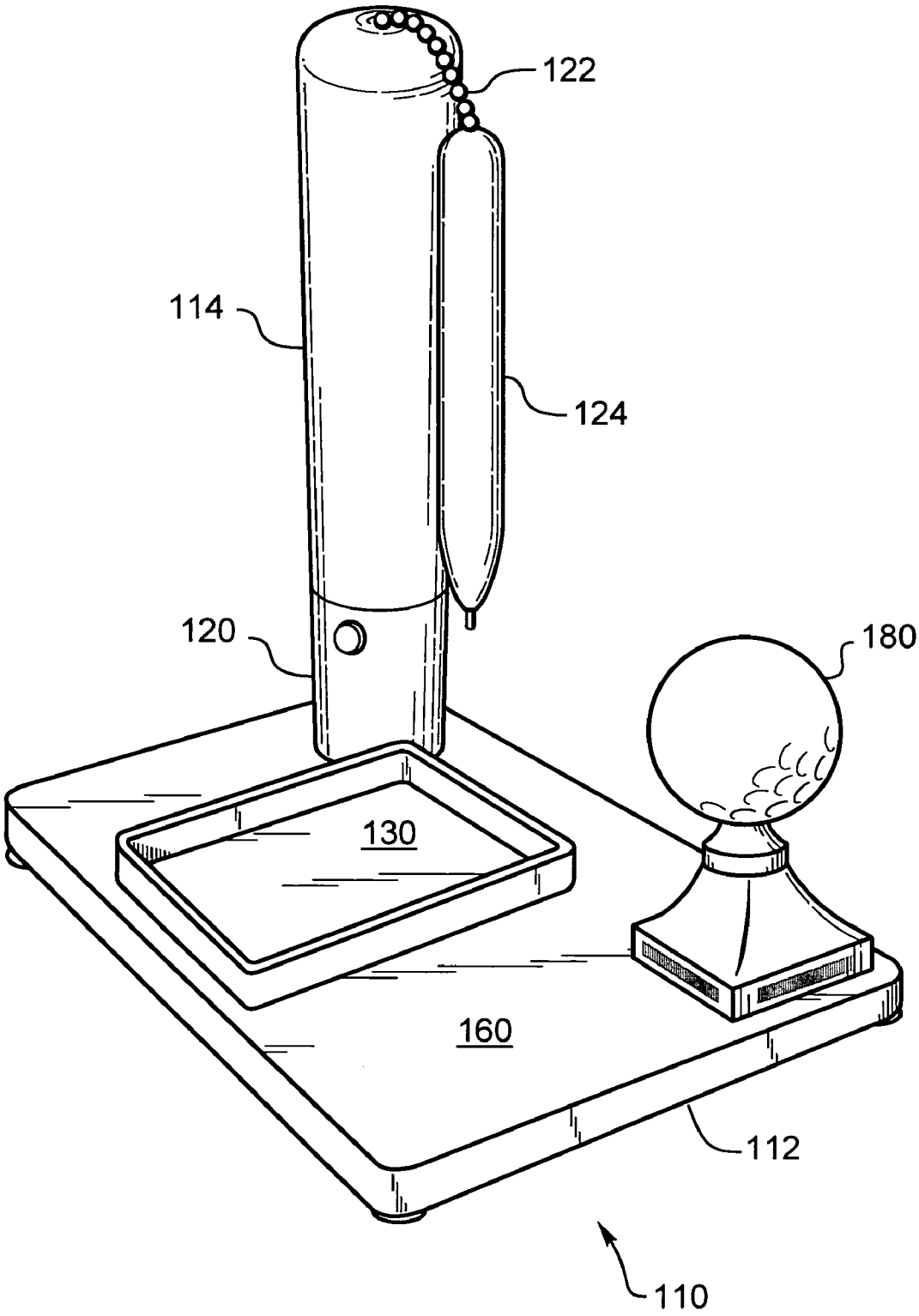
FIG. 3 is a front perspective view of a second embodiment of the freestanding penholder.

In an alternate embodiment, the freestanding penholder 110 may have a tube 114 for an upstanding portion. The base of the tube may contain a retractable tether mechanism 120. The tether 122 extends from pen 124 to the retractable tether mechanism 120 inside of the tube 120 such that when the tether is retracted the pen hangs from the top of the tube as shown in FIG. 3 and the pen is always easily found hanging adjacent the tube 114 and off the surface of the tabletop, desktop or countertop which may be cluttered with papers or other objects which might otherwise obscure the location of the pen.

A note pad holder 130 may be attached to the base 112. The freestanding penholder 110 may have a trophy 180 with a sign attached to the base 112 or a message or advertisement 160 on or in the base.

The tether 22, 122 can be made of any material such as a chain, a beaded chain, a string, and cable, a wire, a ribbon of plastic, or any other material that is compatible with the tether mechanism 20 or 120. The tether retractor mechanism 20, 120 may include springs or an elastic material and may wind the tether around a spool or have a counterbalance, motor or other mechanism for supplying energy for retracting the tether 22, 122 when the pen 24, 124 is not in use.

The pen 24, 124 may be of any style and may have advertising thereon.

Figure 4:
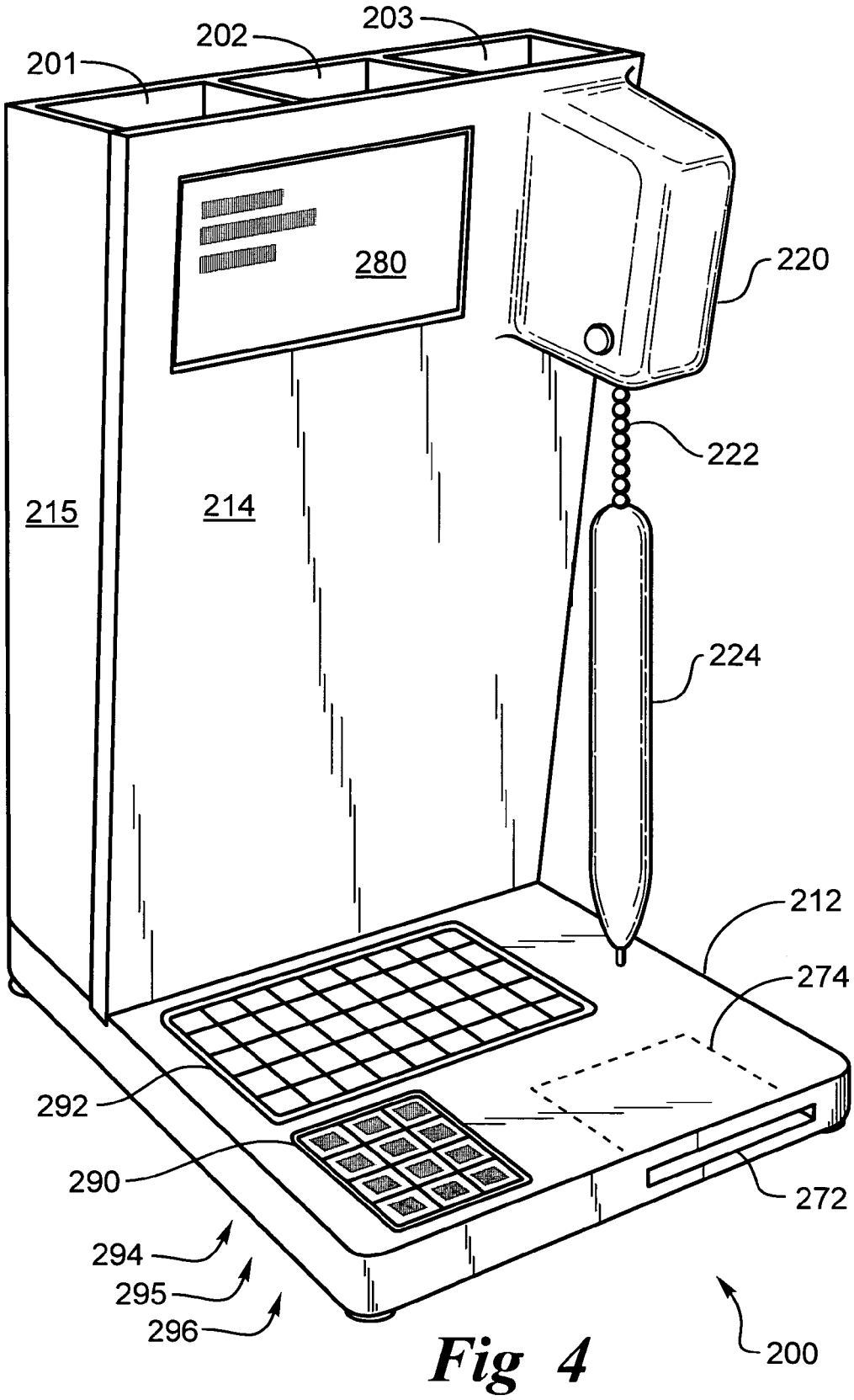
FIG. 4 is a front perspective view of a desk manager with the freestanding penholder as a portion thereof.

Alternatively the penholder stand may have other features for making it into a desktop manager. As shown in FIG. 4 the freestanding penholder desk manager 200 has a base 212 with a calculator keypad 290, a microprocessor 296 to operate a calculator or a database and a battery 294. The upstanding wall 214 has an LCD display 280 connected to the microprocessor 296 to display the calculator data.

An article holder 215 behind the upstanding wall has slots 201, 202, 203 for holding pencils, scissors, rulers, pens or other articles.

The base 212 may also have either alone or in combination with the calculator keypad 290 an alphabetic keypad 292 for entering data into a memory 295 for storing data such as names addresses phone number etc. The data stored can be recalled and displayed on LCD display 280. One means of retrieving data is to enter the first letter of the name of the person desired and then using the up or down arrow keys to scroll through the memory until the persons name is located.

The base 212 may also have a scanner 274 for scanning business cards or other items placed in scanner slot 272. The scanned information can be placed in memory 295 and then manipulated by the microprocessor 296 and displayed on LCD display 280.

The freestanding penholder desk manager 200 has a retractable tether mechanism 220 on the upstanding wall 214, a tether 222 and a pen 224.

Figure 5:
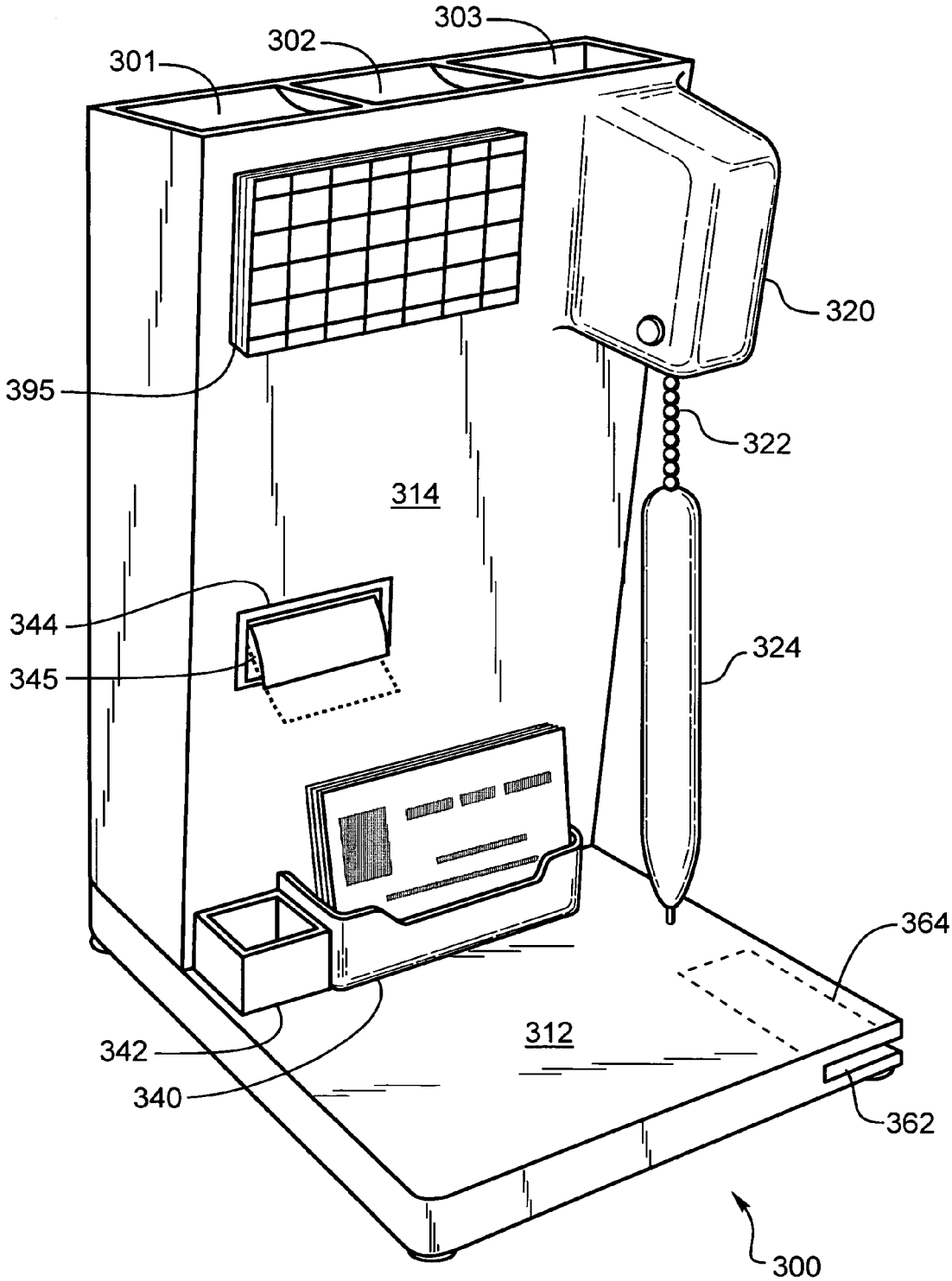
FIG. 5 is a front perspective view of a desk organizer with the freestanding penholder as a portion thereof.
Figure 6:
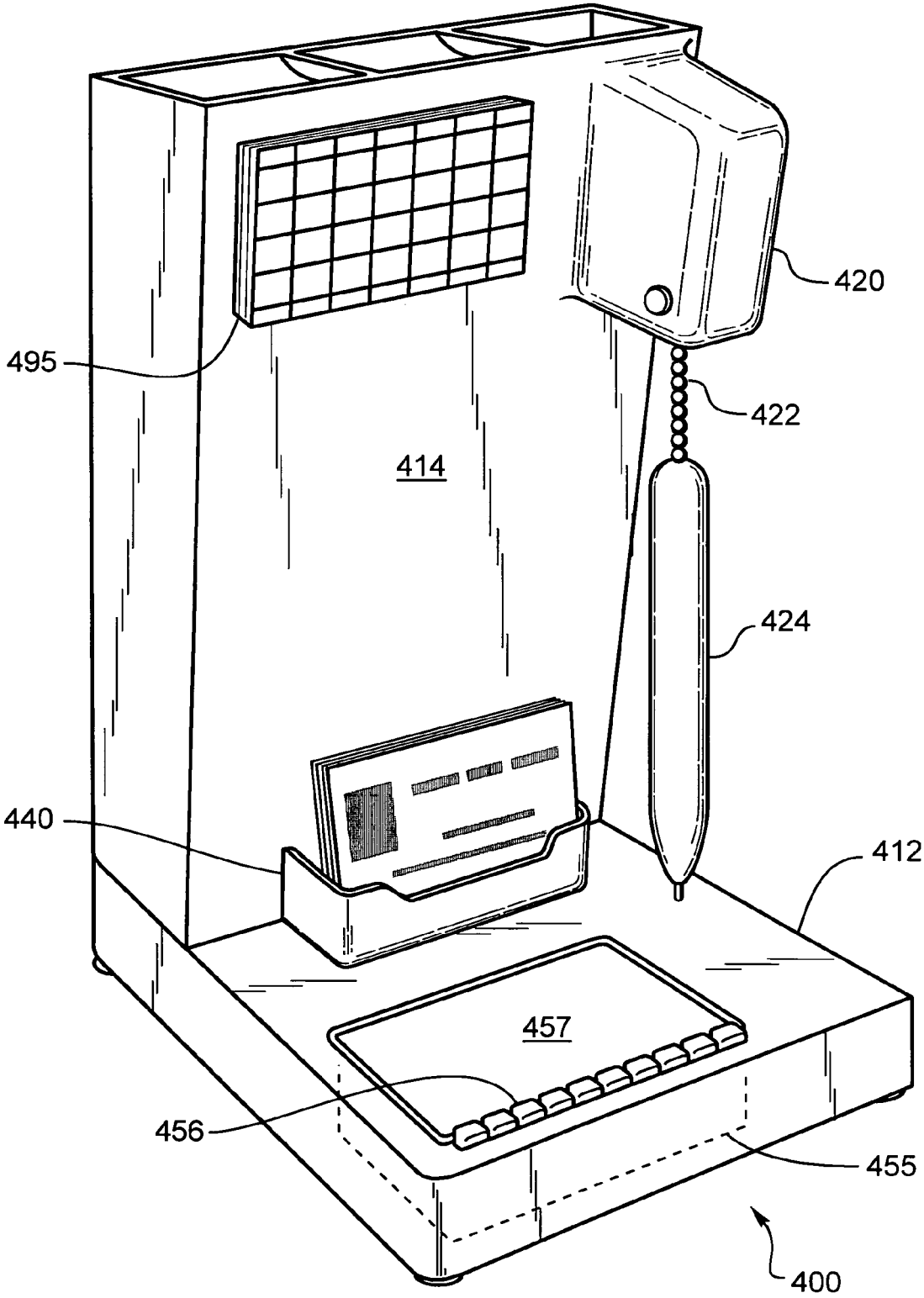
FIG. 6 is a front perspective view of another embodiment of a desk organizer having an index card mechanism with the freestanding penholder as a portion thereof.

In another embodiment as shown in FIG. 5 the desk manager 300 has a base 312 an upstanding wall 314 with trays 301, 302, 303 on the top for holding paper clips, rubber bands, and other articles. The face of the upstanding wall 314 can have a calendar 395 attached on one portion of the face and the retractable tether mechanism 320 tether 322 and pen 324 attached on another portion of the upstanding wall 314. The upstanding wall can also have a stamp dispenser 344 with a slot 345 for accessing the stamps therein. A business card holder 340 and a paper clip bin 342 can be added to the front face of the upstanding wall at the intersection of the upstanding wall 314 and the base 312.

The base may have a built in stapler 364 with a slot 362 to guide the corner of the paper such that the staples will be placed at a uniform distance from the edge of the paper.

In yet another embodiment a desk organizer 400 can have the base 412 with an index cardholder having a mechanical means of opening the cardholder 455 by pressing alphabetically arranges buttons 456 to open lid 457 and flip up the cards in the cardholder 455 to the selected alphabetical card.

The upright wall 414 is at the rear of the base 412. The upright wall 414 supports a calendar 495 and a retractable tether mechanism 420 having a tether 422 and a pen 424. A cardholder 440 can be placed at the intersection of the upright wall 414 and the base 412.

Figure 7:
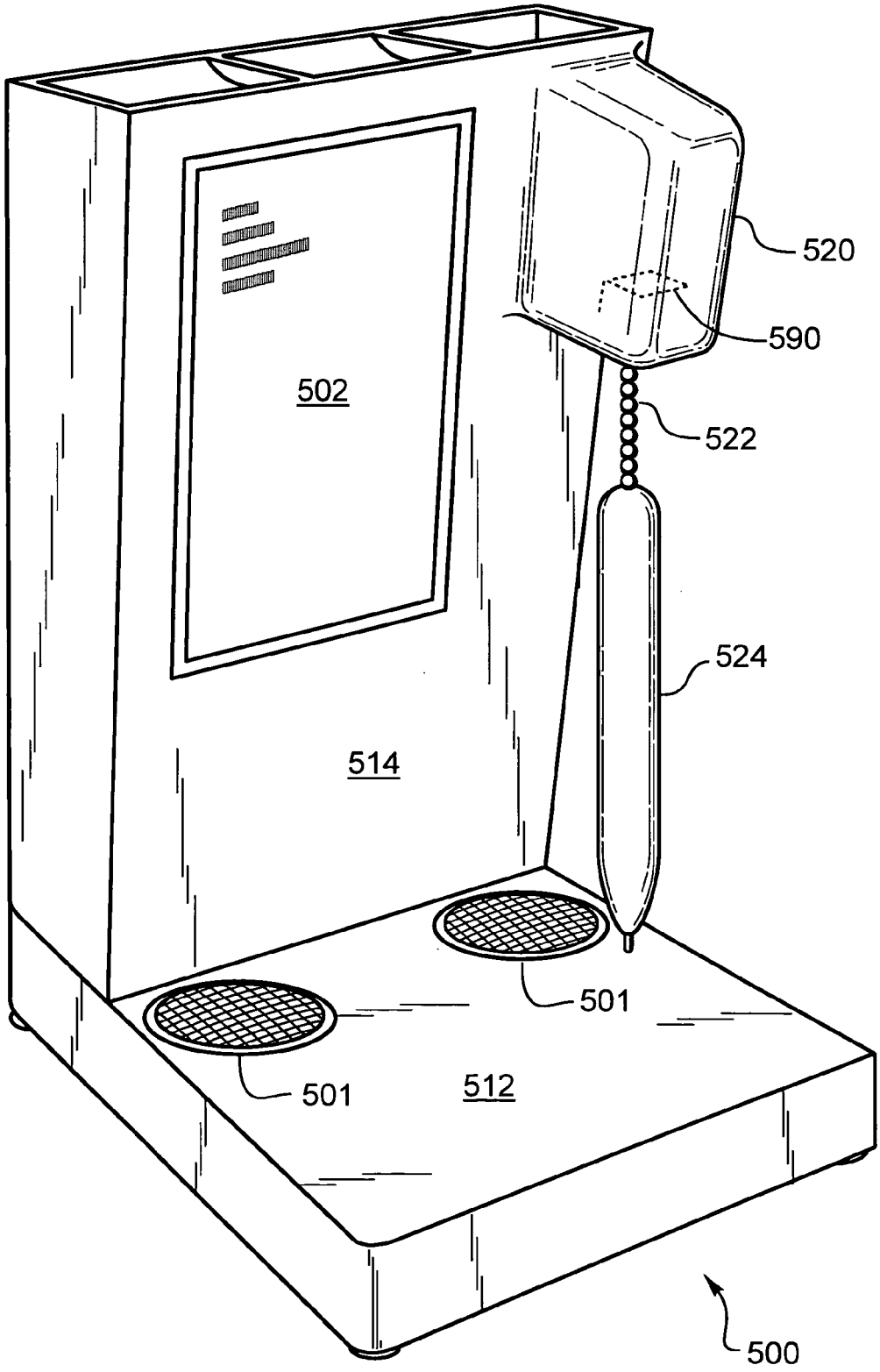
FIG. 7 is a front perspective view of a video monitor embodiment.

FIG. 7 shows a video audio display penholder 500. A video display screen 502 such as a flat panel display can be attached to the upright wall 514, which is attached to base 512. The speakers 501 may be on the upright wall 514 or the base 512. The video may be driven by a cable input leading to a DVD player, a VCR, an Internet connection or some other data input device, not shown. Optionally, a disk player plus a DVD, a hard drive or a memory in the video audio display penholder 500 may provide the data to drive the video and sound played on the video audio display penholder 500. The retractable tether mechanism 520 having a tether 522 and a pen 524 may be adjacent the video display screen 502. A switch 590 in the retractable tether mechanism may activate the audio-video display 500 to play an advertisement for a specified period of time.

Obviously, many modifications and variations of the present invention are possible in light of the above teachings. It is therefore to be understood that, within the scope of the appended claims, the invention may be practiced otherwise than as specifically described.

What is claimed is:

1. A freestanding penholder comprising:

a base portion, having a top surface an upright portion, attached to the top surface of the base portion, the width of the upright portion being no longer than the width of the base, the length of the upright portion being less than the length of the base such that the upright portion leaves an open portion on the surface of the base, a tether with a length greater than the height of the upright portion having, a pen attached, the pen with a length, which is less than the height of the upright portion, attached at one end of the tether, a tether mechanism for extending and retracting the tether within the upright portion above the top surface of the base such that the bottom tip of the pen in the tether retracted position hangs above the height of the bottom surface of the base, the upright portion having an aperture for the tether to extend through thus extending from within to the outside of the upright portion.

2. A freestanding penholder as in claim 1 wherein, the tether mechanism is attached to the top portion of the upright portion.

3. A freestanding penholder as in claim 2 wherein, a wall attached to the base portion comprises the upright portion.

4. A freestanding penholder as in claim 1 wherein, the tether mechanism is attached to the bottom portion of the upright portion.

5. A freestanding penholder as in claim 4 wherein, a tube attached to the base portion comprises the upright portion and the tether extends within the tube.

6. A freestanding penholder as in claim 1 wherein, a paper holder is attached to the base portion.

7. A freestanding penholder as in claim 1 wherein, a paper dispenser is attached to the base portion having a paper dispenser aperture the base portion.

8. A freestanding pen holder as in claim 1 wherein, a paper dispenser is attached to the upright portion having a paper dispenser aperture in the upright portion.

9. A freestanding penholder as in claim 1 wherein, the upright portion has a card holder attached.

10. A freestanding penholder as in claim 1 wherein, the base portion has a card holder attached.

11. A freestanding penholder as in claim 1 wherein, the base portion has an LCD attached.

12. A freestanding penholder as in claim 1 wherein, the upright portion has an LCD attached.

13. A freestanding penholder as in claim 1 wherein, the base portion has trophy attached.

14. A freestanding penholder as in claim 1 wherein, the upright portion has trophy attached.

15. A freestanding penholder as in claim 1 wherein, the tether mechanism has an electrical switch.

16. A freestanding penholder as in claim 15 wherein, the pen holder has a light source thereon, a power source thereon and the switch controls the power to the light source.

17. A freestanding penholder as in claim 15 wherein, the switch controls a LCD.

18. A freestanding penholder as in claim 1 wherein, advertising is displayed on the upright portion.

19. A freestanding penholder as in claim 1 wherein, advertising is displayed on the base portion.

20. A freestanding penholder as in claim 1 wherein, the upright portion is has a slit therein and an advertising card inserts into the slit.

21. A freestanding penholder as in claim 1 wherein,
a keypad is supported on the base and an electronic display is supported on the upright portion.

22. A freestanding penholder as in claim 21 wherein,
a microprocessor a calculator keyboard work in conjunction with the display to provide a calculator on the freestanding penholder.

23. A freestanding penholder as in claim 21 wherein,
a microprocessor, a memory, a numeric keyboard and an alphabet keyboard work in conjunction with the display to provide an index database on the freestanding penholder.

24. A freestanding penholder as in claim 1 wherein,
a scanner in the base scans data and stores it in a memory,
a display for showing the stored information in memory.

25. A freestanding penholder as in claim 1 wherein,
a stamp dispenser is attached to the upright portion.

26. A freestanding penholder as in claim 1 wherein,
a stamp dispenser is attached to the base.

27. A freestanding penholder as in claim 1 wherein,
a stapler is attached to the base and a slot in the base aligns articles to be stapled with the stapler.

28. A freestanding penholder as in claim 1 wherein,
a calendar is attached to the upright portion.

29. A freestanding penholder as in claim 1 wherein,
a calendar is attached to the base.

30. A freestanding penholder as in claim 1 wherein,
a mechanical index card selector is attached to the base.

31. A freestanding penholder as in claim 1 wherein,
a video display screen is attached to the upright portion.

32. A freestanding penholder as in claim 31 wherein,
a speaker is attached to the upright portion.

33. A freestanding penholder as in claim 31 wherein,
a speaker is attached to the base.

34. A freestanding penholder as in claim 1 wherein,
the tether mechanism and tether within the upright are located over the base such that the pen hangs over the area of the top surface of the base.

* * * * *